US006788258B2

(12) United States Patent
Olson

(10) Patent No.: US 6,788,258 B2
(45) Date of Patent: Sep. 7, 2004

(54) PARTIALLY SHARED ANTENNA APERTURE

(75) Inventor: Steven C. Olson, Broomfield, CO (US)

(73) Assignee: ARC Wireless Solutions, Inc., Wheat Ridge, CO (US)

( * ) Notice: Subject to any disclaimer, the term of this patent is extended or adjusted under 35 U.S.C. 154(b) by 0 days.

(21) Appl. No.: 10/408,334

(22) Filed: Apr. 7, 2003

(65) Prior Publication Data

US 2003/0189516 A1 Oct. 9, 2003

Related U.S. Application Data

(60) Provisional application No. 60/371,201, filed on Apr. 9, 2002.

(51) Int. Cl.[7] ..... H01Q 1/38

(52) U.S. Cl. ..... 343/700 MS; 343/853; 343/815

(58) Field of Search ..... 343/700 MS, 815, 343/833, 834, 853; 342/375

(56) References Cited

U.S. PATENT DOCUMENTS

| | | | | |
|---|---|---|---|---|
| 4,464,663 A | | 8/1984 | Lalezari et al. | |
| 5,554,995 A | * | 9/1996 | Jun | 343/700 MS |
| 6,002,370 A | * | 12/1999 | Mckinnon et al. | 343/700 MS |
| 6,121,929 A | | 9/2000 | Olson et al. | |
| 6,288,677 B1 | | 9/2001 | Fink | |
| 6,359,588 B1 | | 3/2002 | Kuntzsch | |
| 6,621,456 B2 | * | 9/2003 | Ryken et al. | 343/705 |
| 6,700,542 B2 | * | 3/2004 | Borlez et al. | 343/700 MS |

* cited by examiner

*Primary Examiner*—Tan Ho
(74) *Attorney, Agent, or Firm*—Ancel W. Lewis, Jr.

(57) ABSTRACT

An antenna system includes a ground plane, an aperture array of patch radiating elements and a feed structure. The feed structure has a first and second beam forming networks that each couple to selected radiating elements to form first and second antenna arrays. At least one and less than all of the radiating elements are shared by the first and second antenna arrays.

9 Claims, 2 Drawing Sheets

PARTIALLY SHARED ANTENNA APERTURE

This application claims the benefit under 35 U.S.C. §119(e) of the U.S. provisional patent application No. 60/371,201 filed Apr. 9, 2002.

TECHNICAL FIELD

The present invention relates to antennas and more particularly to an antenna system with a multi-port array of partially shared radiating elements.

BACKGROUND ART

Antenna systems with arrays of patch radiating elements are useful for various wireless communications applications, and particularly in fixed wireless access. Where such antenna systems are produced in large quantities, it is important that the antenna systems be reliable and inexpensive, and have minimum radiating area or aperture size.

Prior known antenna systems have used multi-port, fully shared arrays. U.S. Pat. No. 4,464,663 to Lalezari et al. and U.S. Pat. No. 6,359,588 to Kuntzsch each disclose an antenna having two elements with each element having dual polarization. U.S. Pat. No. 6,121,929 to Olson et al. discloses an antenna with a two by two array of dual slant 45 linearly polarized elements. Such fully shared arrays with dual polarized elements can provide dual use of a frequency or use of two frequencies while requiring about half the aperture area and half the number of elements as would be required with arrays of unshared elements.

A single layer or monolithic feed layout for an array of patch radiating elements avoids expensive and unreliable cross-overs and feed throughs. As the number of radiating elements in a multi-port array with a single layer feed layout increases, the feed network topology becomes more complex and the feed lines become significantly longer. The prior known fully shared arrays that have simple feed network topology with relatively short feed lines were therefore limited to a two by two array size.

DISCLOSURE OF THE INVENTION

An antenna system includes a ground plane, an aperture array of patch elements and a feed structure. The feed structure has a first beam forming network and a second beam forming network. The first beam forming network is coupled to a selected first group of elements at a first angle to form a first antenna array having a first polarization. The second beam forming network is coupled to a selected second group of elements at a second polarization angle to form a second antenna array having a second polarization. The patch radiating elements of the aperture array are partially shared by the first and second antenna arrays, with the first and second antenna arrays sharing at least one but less than all of the elements. By partially sharing elements of multiple arrays one can more efficiently layout the array beam forming networks of each array and minimize the size of the combined aperture.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
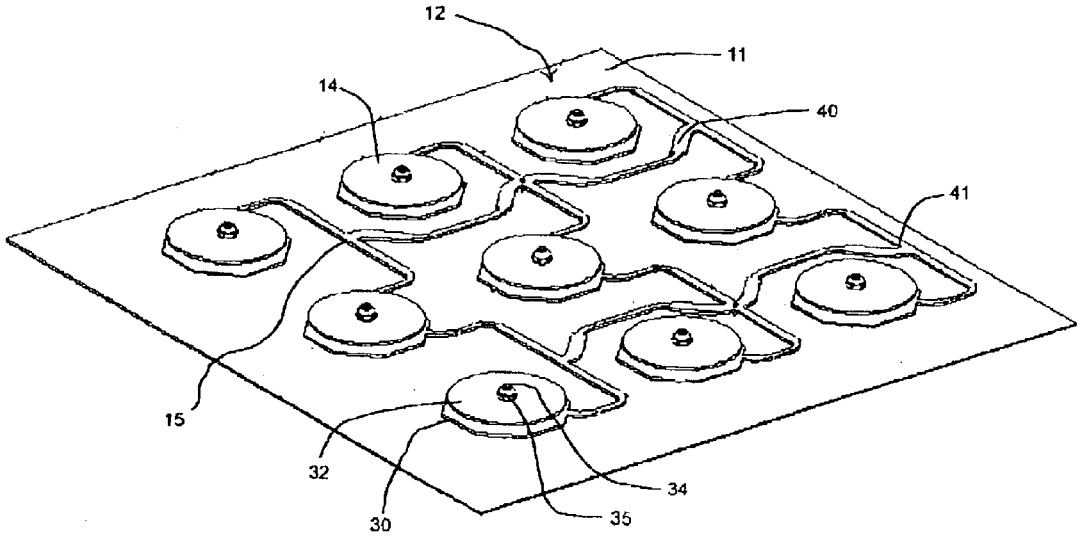
FIG. 1 is a perspective view of an antenna system embodying features of the present invention.

Referring now to FIGS. 1 to 4, the antenna system of the present invention includes a substantially planar ground plane 11, an aperture array 12 of patch radiating elements 14, a monolithic or single layer feed structure 15, and radio frequency (RF) first and second connectors 16 and 17. The first and second connectors 16 and 17 provide for connection of the antenna system to wireless devices. The aperture array 12 and the feed structure 15 are spaced a substantially uniform distance from the ground plane 11. In the illustrated embodiment, the ground plane 11 is square, and the aperture array 12 is a three by three array with first, second, and third rows 20, 21 and 22, and first, second and third columns 25, 26, 27. Other ground plane shapes and other array sizes can be used with the present invention. The ground plane 11, radiating elements 14, and feed structure 14 are preferably made of sheet aluminum and have a size and shaped dictated by a particular application. Other highly conductive sheet metal materials such as copper and brass can also be used. These materials can be formed by being stamped, laser cut or printed/etched on an RF compatible substrate.

Figure 2:
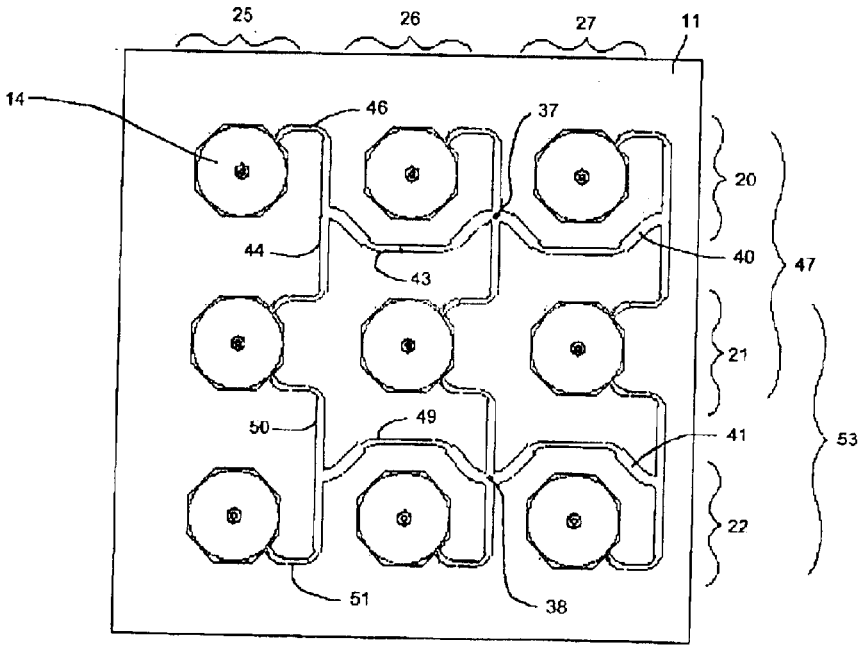
FIG. 2 is a front plan view of the system of FIG. 1.
Figure 3:
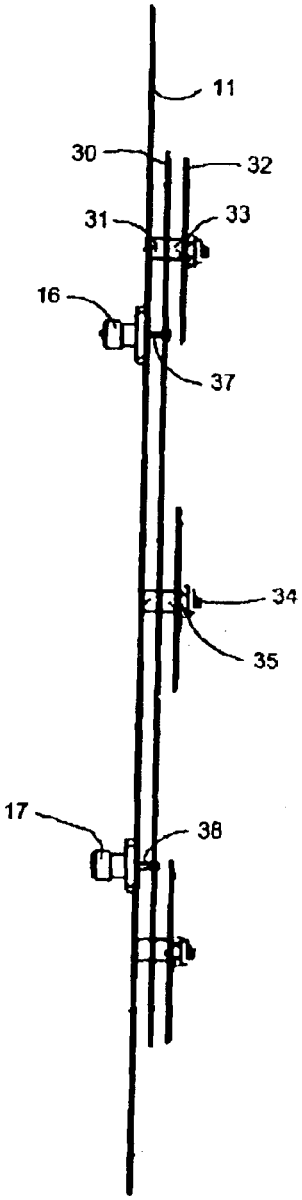
FIG. 3 is a side elevation view of the system of FIG. 1.
Figure 4:
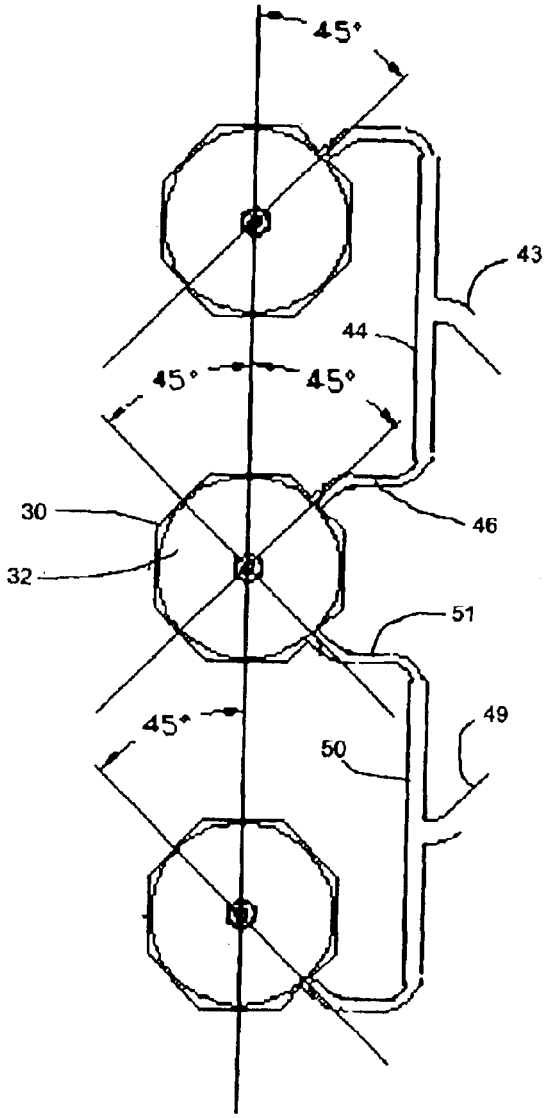
FIG. 4 is an enlarged top plan view of a column of radiating elements of the system of FIG. 1.

Describing the specific embodiments herein chosen for illustrating the invention, certain terminology is used which will be recognized as being employed for convenience and having no limiting significance. For example, the terms "horizontal", "vertical", "upper", "lower", "left" and "right" refer to the illustrated embodiment as shown in FIG. 2. Also, angles described shall be clockwise relative to "vertical". Further, all of the terminology above-defined includes derivatives of the word specifically mentioned and words of similar import.

The radiating elements 14 shown are air-loaded microstrip stacked patch antenna elements, each including an octagonal driver patch 30 spaced from the ground plane 11 by a first spacer 31, and a round parasitic patch 32 spaced from the driver patch 30, opposite the ground plane 11, by a second spacer 33. The octagonal driver patches 30 are oriented with two spaced opposed horizontal, vertical, 45 degrees and −45 degrees edges each. In the illustrated embodiment each radiating element 14 is attached to the ground plane 11 by a threaded PEM stud 34 that is pressed into the ground plane 11 and extends through the centers of the first spacer 31, the driver patch 30, the second spacer 33 and the parasitic patch 32, with a nut 35 threading onto stud 34 over the parasitic patch 32. Other fastener types can be used such as clips, rivets, welds and crimping. The first and second spacers 31 and 33 can be separate individual parts or can be integral to the driver patch 30 and parasitic patch 32. The illustrated embodiment uses separate aluminum spacers but non-metallic spacers could also be used.

The first connector 16 is mounted on the ground plane 11 on the-side opposite the aperture array 12, and is located between the first row 20 and the second row 21 and between the second column 26 and the third column 27. The first connector 16 includes a first connector pin 37 that extends through a relief hole in the ground plane 11 toward the aperture array 12. The second connector 17 is mounted on the ground plane 11 on the side opposite the aperture array 12, and is located between the second row 21 and the third row 22 and between the second column 26 and the third column 27. The second connector 17 includes a second connector pin 38 that extends through a relief hole in the ground plane 11 toward the aperture array 12.

The feed structure 15 shown includes an air-loaded microstrip transmission line first beam forming network 40 and an air-loaded microstrip transmission line second beam forming network 41, that are each substantially co-planar with the driver patches 30. The first and second beam forming networks 40 and 41 are operative-for transferring RF energy between the radiating elements 14 and the first and second connectors 16 and 17, respectively. The first and second beam forming networks 40 and 41 also function as RF combiners/dividers.

The first beam forming network 40 connects to the first connector pin 37 and includes a pair of transmission line first primary sections 43 that extend outwardly in a substantially horizontal direction on either side from the first connector pin 37. First secondary sections 44 connect to the first primary sections 43 at the first connector pin 37 and at the outer ends of the first primary sections 43, and extend upwardly and downwardly therefrom. A first coupling section 46 connects to the end of each of the six first secondary sections 44 opposite the end connected to a first primary section 43. Each of the six first coupling sections 46 connects at a first angle of 45 degrees to the upper, right edge of the driver patch 30 of one of the radiating elements 14 of the first and second rows 20 and 21. The first beam forming network 40 and the radiating elements 14 of the first and second rows 20 and 21 form a two by three first antenna array 47 with a 45 degree polarization.

The second beam forming network 41 connects to the second connector pin 38 and includes a pair of transmission line second primary sections 49 that extend outwardly in a substantially horizontal direction on either side from the second connector pin 38. Second secondary sections 50 connect to the second primary sections 49 at the second connector pin 38 and at the outer ends of the second primary sections 49, and extend upwardly and downwardly therefrom. A second coupling section 51 connects to the end of each of the six second secondary sections 50 opposite the end connected to a second primary section 49. Each of the six second coupling sections 51 connects at a second angle of 135 degrees to the lower, right edge of the driver patch 30 of one of the radiating elements 14 of the second and third rows 21 and 22. The second beam forming network 41 and the radiating elements 14 of the second and third rows 21 and 22 form a two by three second antenna array 53 with a −45 degree polarization.

The radiating elements 14 of the aperture array 12 are partially shared by the first and second antenna arrays 47 and 54. The radiating elements 14 of the first row 20 are unshared and have a 45 degree polarization. The radiating elements 14 of the second row 21 are shared and have a dual slant ±45 degree polarization. The radiating elements 14 of the third row 20 are unshared and have a −45 degree polarization.

The present invention may be applied by using various RF transmission line and element technologies. In the illustrated embodiment the first and second antenna arrays 47 and 54 operate on the same frequency band. The radiating elements 14 can also be configured to operate the first and second antenna arrays 47 and 54 across different frequency bands, creating a dual frequency band antenna system. The dual polarization characteristic of the aperture array 12 does not have to be linear, as in the illustrated embodiment, but can be of other combinations such as left and right hand circular polarization. Angles other than the shown ±45 degrees, such as 0 and 90 degrees, may be used. More than two arrays can be partially shared while using the same aperture. Array sizes and shapes other than the three by three square array shown may be used.

The antenna system of the present invention provides a reduced aperture area and fewer radiating elements than unshared antenna systems. The antenna system of the present invention allows larger arrays than the prior known fully shared systems while providing less complex and shorter beam forming networks. The present invention further provides greater flexibility in the layout of the beam forming networks of the aperture.

Although the present invention has been described with a certain degree of particularity, it is understood that the present disclosure has been made by way of example and that changes in details of structure may be made without departing from the spirit thereof.

What is claimed is:

1. A partially shared aperture antenna system comprising:

an aperture array of radiating elements, a first beam forming network coupled at a first polarization angle to a selected first group of said radiating elements to form a first antenna array having a first polarization, and a second beam forming network coupled at a second polarization angle, transverse to said first polarization angle, to a selected second group of said radiating elements, said first and second groups having at least one of said radiating element in common and less than all said radiating elements in common, said second beam forming network and said second group of said elements forming a second antenna array having a second polarization.

2. The antenna system as set forth in claim 1 wherein said first and second beam forming networks form a single layer feed structure.

3. The antenna system as set forth in claim 2 wherein said first and second beam forming networks are air-loaded microstrip transmission lines.

4. The antenna system as set forth in claim 1 wherein said aperture array includes first, second and third rows of said radiating elements, said first group consists of said first and second rows, and said second group consists of said second and third rows, whereby said first and third rows are unshared and said second row is shared by said first and second antenna arrays.

5. The antenna system as set forth in claim 1 wherein said first polarization is orthogonal to said second polarization.

6. The antenna system as set forth in claim 1 wherein said first group has a 45 degree polarization and said second group has a −45 degree polarization.

7. The antenna system as set forth in claim 1 wherein said radiating elements are patch radiating elements.

8. The antenna system as set forth in claim 7 wherein said radiating elements are air-loaded microstrip stacked patch radiating elements, with each said radiating element including a driver patch and a parasitic patch spaced from said driver patch.

9. A partially shared aperture antenna system comprising:

a substantially planar ground plane, an aperture array of air-loaded microstrip stacked patch radiating elements on said ground plane, including first, second and third rows by first, second and third columns of said radiating elements, each said radiating element including a driver patch spaced from said ground plane and a parasitic patch spaced from said driver patch opposite said ground plane, an air-loaded microstrip transmission line first beam forming network spaced from said ground plane and substantially planar with said driver patches, said first beam forming network connecting at a 45 degree angle to said radiating elements of said first and second rows to form a first antenna array having a 45 degree polarization, and an air-loaded microstrip transmission line second beam forming network spaced from said ground plane and substantially planar with said driver patches, said first beam forming network connecting at a 135 degree angle to said radiating elements of said second and third rows to forming a second antenna array having a −45 degree polarization.

* * * * *